United States Patent [19]

Yorifuji et al.

[11] Patent Number: 5,055,738

[45] Date of Patent: Oct. 8, 1991

[54] LOW-PRESSURE MERCURY VAPOR DISCHARGE LAMP HAVING A FOLDED TUBE

[75] Inventors: Takashi Yorifuji, Zushi; Masashi Saigo, Kamiya, both of Japan

[73] Assignee: Toshiba Lighting & Technology Corporation, Tokyo, Japan

[21] Appl. No.: 448,839

[22] Filed: Dec. 12, 1989

[30] Foreign Application Priority Data

Dec. 12, 1988 [JP] Japan ..... 63-313157

[51] Int. Cl.[5] ..... H01J 1/62

[52] U.S. Cl. ..... 313/490; 313/493; 313/609

[58] Field of Search ..... 313/490, 493, 609, 610, 313/611, 608

[56] References Cited

U.S. PATENT DOCUMENTS

| | | | |
|---|---|---|---|
| 4,374,340 | 2/1983 | Bouwknegt | 313/608 |
| 4,481,442 | 11/1984 | Albrecht et al. | 313/493 |
| 4,530,710 | 7/1985 | Dullea | 313/493 |
| 4,694,215 | 9/1987 | Hofmann | 313/44 |
| 4,786,841 | 11/1988 | Fohl et al. | 313/493 |

FOREIGN PATENT DOCUMENTS

| | | | |
|---|---|---|---|
| 0061758 | 10/1982 | European Pat. Off. . | |
| 0204060 | 12/1986 | European Pat. Off. | 313/493 |
| 0327346 | 8/1989 | European Pat. Off. . | |
| 60-225346 | 11/1985 | Japan . | |
| 0230256 | 10/1986 | Japan | 313/493 |
| 0281251 | 12/1987 | Japan | 313/493 |
| 0189850 | 7/1989 | Japan | 313/609 |

OTHER PUBLICATIONS

"Patent Abstracts of Japan", vol. 12, No. 168 (E-611) [3015], May 1988.

J. Illum. Engng. Inst. Jpn., vol. 71, No. 1, 12/1987 (pp. 11-14).

*Primary Examiner*—Donald J. Yusko

*Assistant Examiner*—N. D. Patel

*Attorney, Agent, or Firm*—Foley & Lardner

[57] ABSTRACT

A low-pressure mercury vapor discharge lamp is composed of a glass tube which has a discharge passage having two end portions arranged in the same direction, a folded portion in the direction opposite the portions, a pair of electrodes provided between the portions and amalgam provided in an end portion and for controlling the mercury vapor pressure. The tube has a configuration such that a low temperature region is formed in an inner face of the tube adjacent to the folded portion when the lamp is turned on in the state where the folded portion is oriented in a direction where it is affected by gravity, whereas, the low temperature region is formed in an inner face of the tube other than the folded portion when the lamp is turned on in the state that the folded portion is oriented in a direction where it is not affected by gravity, at a room temperature.

5 Claims, 2 Drawing Sheets

LOW-PRESSURE MERCURY VAPOR DISCHARGE LAMP HAVING A FOLDED TUBE

BACKGROUND OF THE INVENTION

1. Field of the Invention

The present invention relates to a low-pressure mercury vapor discharge lamp arranged to have a folded portion in the middle of a discharge passage and two end portions thereof oriented in the same direction, and is turned on such that the portions are oriented in a direction where it will or will not be affected by gravity. More particularly, invention relates to a low-pressure mercury vapor discharge lamp which preferably starts and maintains a high luminous efficacy even if the direction of the portions, ambient temperature, etc. are changed when the lamp is turned on.

2. Description of the Prior Art

A conventional compact fluorescent lamp is arranged such that two end portions of a discharge passage are oriented in the same direction and at least one folded portion is oriented in the opposite direction. This lamp has a drawback that mercury vapor pressure in a tube rises too high at a high temperature.

A H-shaped type fluorescent lamp such as disclosed in Japanese Patent Laid-Open No. 55-133744 is arranged such that middle portions of two straight tubes are joined to each other through a connecting tube section to form a H-shaped folded portion in which a low temperature region is formed in the end portion of the H-shaped tube to condense excessive mercury so as to control the vapor pressure in the tube.

Furthermore, a fluorescent lamp such as disclosed in Japanese Patent Laid-Open No. 57-174846 is arranged such that a middle portion of a straight tube is bent to form a U-shaped folded portion and inside diameters of the straight tube, the summit portion of a bent section and a portion on the way of the bent section having dimensions in $D_1$, $D_2$ and $D_3$ respectively, satisfies $\leqq D_2 < D_3$ and a low temperature region is formed in an inner surface of an outer angle section of the portion along the bent section to condense excessive mercury so as to control the vapor pressure in the tube.

In these conventional lamps, owing to natural cooling, the temperatures of low temperature regions are different from each other in the case of orienting the folded portion in a direction where it is not affected by gravity (This is called the "base down state" hereinafter.) and in the case of orienting the folded portion in a direction where it is affected by gravity (This is called the "base up state" hereinafter.), even if the ambient temperatures are the same as each other. Furthermore, when the lamp is turned on in the base down state, droplets of condensed mercury may be dropped to an electrode to make the brightness fluctuate and damage the electrode.

As for the solution to the above mentioned problems, such as disclosed in Japanese Patent Laid-Open No. 60-225346, a low-pressure mercury vapor discharge lamp has been developed which employs amalgam for controlling the mercury vapor pressure so that droplets of condensed mercury are not dropped even if the lamp is turned on in the base down state. In the above mentioned discharge lamp, since mercury is tightly condensed in the low temperature region, amalgam in which mercury is more tightly condensed than that (amalgam capable of strongly absorbing mercury vapor) must be employed. Owing to that, on the contrary, drawbacks such mercury not being discharged sufficiently, the lamp not preferably starting or not turning on, and so-called black shade (i.e., a film of mercury compound forming on a glass wall of a tube), etc. are yielded. If amalgam in which mercury is not tightly condensed is employed, mercury is condensed in the above mentioned low temperature region in the case of the base down state. This cannot solve the problem that droplets of condensed mercury drop.

SUMMARY OF THE INVENTION

An object of the present invention is to provide a low-pressure mercury vapor discharge lamp in which droplets of condensed mercury do not drop and which preferably controls the mercury vapor pressure irrespective of the direction of a base member which permits the lamp to be used in a suitable fixture, preferably starts even if an ambient temperature fluctuates too much, and which also maintains a high luminous efficacy.

In order to achieve the above mentioned object, a low-pressure mercury vapor discharge lamp according to the present invention is provided with a low temperature region formed in a portion of a tube around a folded portion of a discharge passage and amalgam arranged in an inner surface of an end portion of the tube in which mercury is adequately and weakly condensed in the low temperature region and also in the amalgam. The first embodiment of the low pressure mercury vapor discharge lamp of the present invention is provided with a H-shaped type folded portion in which a low temperature region is formed and whose dimension is specified to equalize the capability of the low temperature region to condense mercury, to that of amalgam to do so. The second embodiment of the low-pressure mercury vapor discharge lamp of the present invention is provided with a U-shaped folded portion in which a low temperature region is formed and whose dimension is specified to equalize the capability of the low temperature region to condense mercury, to that of amalgam to do so.

The low-pressure mercury vapor discharge lamp of the present invention provided with a folded portion shows mercury vapor pressure characteristic similar to that of pure mercury at a low temperature and shows the mercury vapor pressure characteristic belonging only to amalgam at a high temperature. For that reason, the low-pressure mercury vapor discharge lamp of the present invention employs amalgam in which mercury is weakly condensed. Accordingly, if mercury is tightly condensed in the folded portion, mercury is also condensed when the lamp is turned on in the case of the base down state.

In the present invention, the cooling capability of the low temperature region adjacent to the folded portion is adequately weakened. This results in the temperature at the folded portion rising in the base down state to cause mercury not to be condensed. The mercury vapor pressure is controlled by another low temperature region or amalgam. On the contrary, the low temperature region is formed adjacent to the folded portion in the base up state. This causes the mercury vapor pressure to be determined by the temperature of the low temperature region or the amalgam. (In other words, the mercury vapor pressure is controlled by the low temperature region or the amalgam whose vapor pressure is lower than the other.)

BRIEF DESCRIPTION OF THE DRAWINGS

The present invention will now be described in detail with reference to the accompanying drawings, in which.

DETAILED DESCRIPTION OF THE PREFERRED EMBODIMENTS

Figure 1:
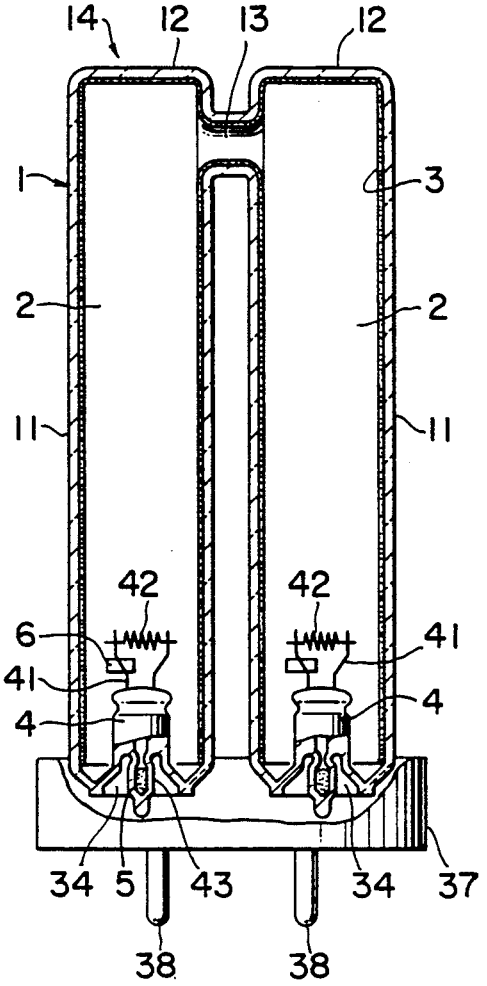
FIG. 1 is a diagrammatic sectional view of a preferred embodiment of a low-pressure mercury vapor discharge lamp according to the present invention.

The present invention will now be described in detail with reference to the accompanying drawings. FIG. 1 shows an embodiment of a H-shaped type fluorescent lamp according to the present invention.

In the figure, the H-shaped type fluorescent lamp comprises a H-shaped type tube 1, discharge passages 2 and 2 formed in the tube 1, a phosphor layer 3 formed on the inner face of the tube 1, stems 4 and 4 for caulking both end portions of the tube 1, main amalgam 5 stored in the end portion of the tube 1 and auxiliary amalgam 6 is supported by wire 41.

The tube 1 is composed such that two longitudinal glass tube sections 11 and 11 are arranged parallel to each other, the other end portions 12 and 12 are caulked which will be folded, and a transverse connecting tube section 13 is provided between the side faces adjacent to the end portions 12 and 12 to join the glass tube sections 11 and 11 to each other and also join the discharge passages 2,2 to each other in a H-shape so as to form a folded portion 14.

A pair of lead wires 41 and 41 is embedded in the stem 4 to support a filament 42. Main amalgam 5 is stored in an exhaust tube 43 and auxiliary amalgam 6 is attached to one of the lead wires 41 and 41. The filament 42 is electrically connected to a terminal pin 38.

Figure 2:
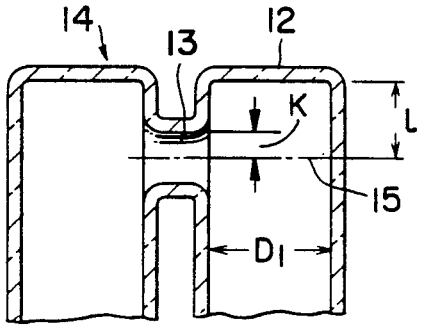
FIG. 2 is a diagrammatic sectional view showing a folded portion and dimension thereof of the low-pressure mercury vapor discharge lamp of FIG. 1.

FIG. 2 shows the folded portion 14. (The fluorescent film 3 is not shown here.) In the figure, the distance between a center line 15 of the transverse connecting tube section 13 and the inner wall of the end portion 12 is l and the inside diameter of the longitudinal portion of the glass tube 11 is $D_1$ provides the following relationship. $K<l \leqq 0.8\ D_1$ For the main amalgam 5, various amalgams are employed whose mercury vapor pressures at the solid and liquid phase coexisting critical temperatures are in the range of 0.01 to 0.2 Torr. Usual critical temperatures of these amalgams are about 80 to 130° C.

Figure 5:
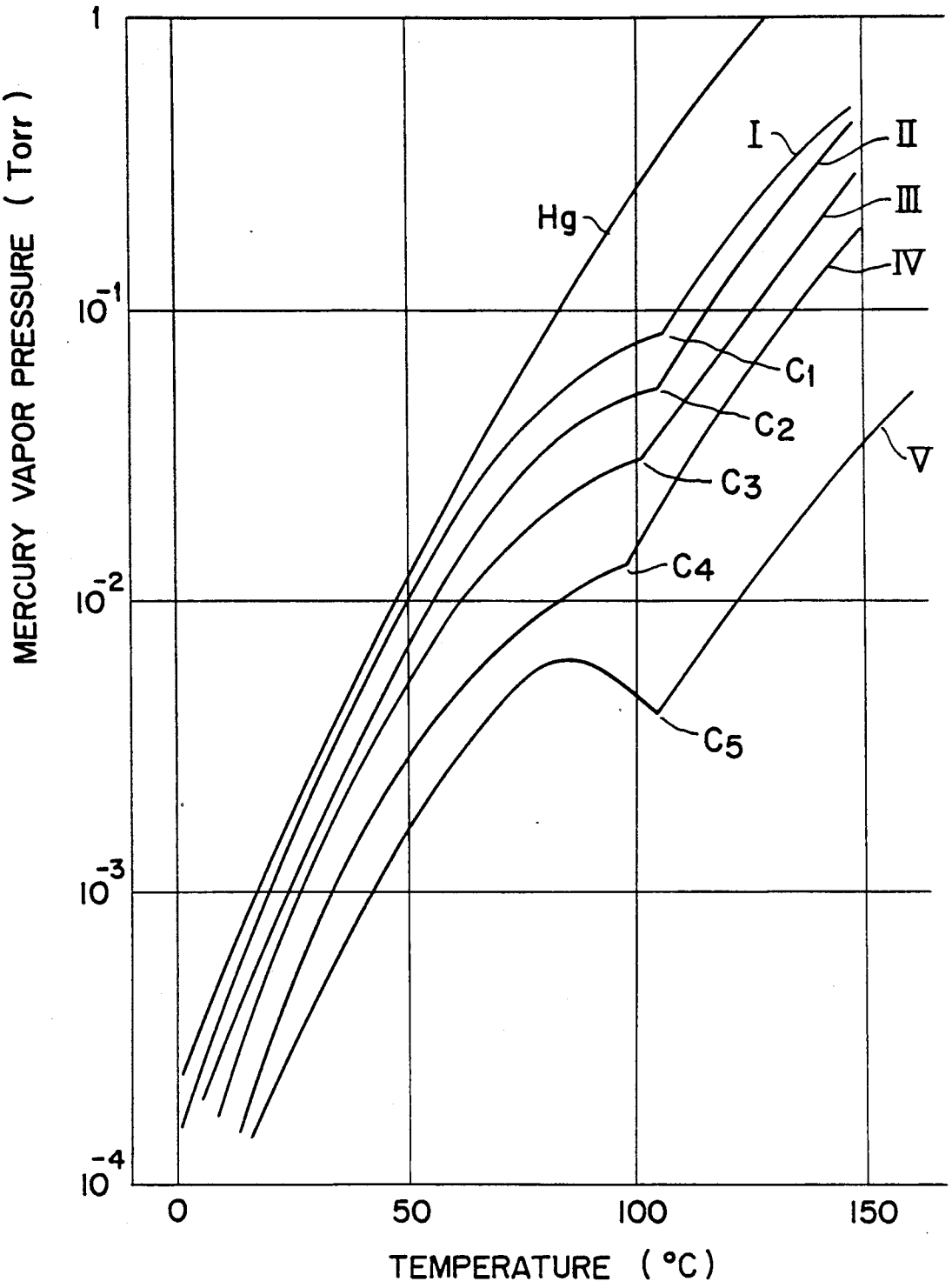
FIG. 5 shows mercury vapor pressure curves of amalgams employed to the both embodiments, and amalgam and pure mercury which is to be compared to the amalgams.

FIG. 5 shows some examples of those amalgams and mercury vapor pressure characteristics thereof. In the figure, the curves I, II, III, IV, and V show the vapor pressure curves of the amalgams expressed as Bi(54.2 weight %).Pb(41.8 weight %).Hg(4.0 weight %), Bi(53.2 weight %).Pb(40.9 weight %).In(1.9 weight %).Hg(4.0 weight %), Bi(51.6 weight %).Pb(39.6 weight %).In(4.8 weight %).Hg(4.0 weight %), Bi(48.9 weight %).Pb(37.5 weight %).In(9.6 weight %).Hg(4.0 weight %) and Bi(64.3 weight %).In(31.7 weight %).Hg(4.0 weight %) for comparison, respectively and the points $C_1$, $C_2$, $C_3$, $C_4$ and $C_5$ indicate the solid and liquid phase coexisting critical temperatures of the amalgams, respectively. The curve Hg shows the vapor pressure curve of pure mercury. As is understood by the figure, all the solid and liquid phase coexisting critical temperatures $C_I$ to $C_{IV}$ of the embodied amalgams I to IV are in the range of 0.01 to 0.2 Torr, while the solid and liquid phase coexisting critical temperature $C_V$ of the amalgam V, the example to be compared with those amalgams is 0.003 ($3\times10^{-3}$) Torr.

The operation of the H shaped type fluorescent lamp embodied in the present invention will now be described in detail. The folded portion 14 of the H-shaped type fluorescent lamp embodied in the present invention is specified as above so as to have low cooling capability. When the lamp is turned on in the base up state at a room temperature, the folded portion 14 is oriented in a downward direction in the field of gravity and is not affected by convection. This results in that the folded portion 14 is adequately cooled by natural cooling so that a low temperature region is formed on the inner face of the end portion 12. The mercury vapor pressure in the tube 1 is controlled by either one of the mercury vapor pressures of the low temperature region or main amalgams whose mercury vapor pressure is close to that of the tube 1. The temperature of the main amalgam 5 will be usually higher than that of the folded portion 14, since the main amalgam 5 is located in upper position. This results in the mercury vapor pressure of the main amalgam 5 rising too high to control the mercury vapor pressure in the tube 11. On the contrary, even when the ambient temperature rises, the rising rate of the mercury vapor pressure of the main amalgam is low. This results in the main amalgam 5 controlling the mercury vapor pressure in the tube 11.

When the H-shaped type fluorescent lamp embodied in the present invention is turned on in the base down state, the folded portion 14 is oriented in a downward direction in the field of gravity and heated by convection. This results in the folded portion 14 not being sufficiently cooled by natural cooling, and the low temperature region is thus formed in the portion such as a tube end portion other than the folded portion 14 and mercury vapor pressure rises to a level higher than $6\times10^{-3}$ Torr, because the heat dissipation rate becomes low despite the main amalgam 5 receiving much of the heat generated by the lamp. In the fluorescent lamp, however, as mentioned above, the pressure at the solid and liquid phase coexisting critical temperature of the main amalgam 5 is in the range of 0.01 to 0.2 Torr and the main amalgam 5 is oriented in a downward direction in the field of gravity so that the temperature of the main amalgam 5 is lower than that of the upper portion of the tube 1. Thus, it is possible to have an adequate mercury vapor pressure as shown by the curves $C_1$–$C_5$, which represent lower mercury vapor pressures than that of pure Hg as understood from FIG. 5. This results in that the mercury vapor pressure in the tube 11 is adequately maintained and mercury does not drop, since the mercury does not condense in the folded portion 14. Furthermore, the mercury vapor pressure in the tube 11 is not to rise too much compared to pure Hg even if the ambient temperature is too high.

As is mentioned above, the fluorescent lamp embodied in the present invention adequately maintains the mercury vapor pressure in the tube 11 even if the ambient temperature fluctuates so that the lamp preferably starts, and maintains a high luminous efficacy without respect to that the lamp is turned on in the base up state or base down state.

Figure 3:
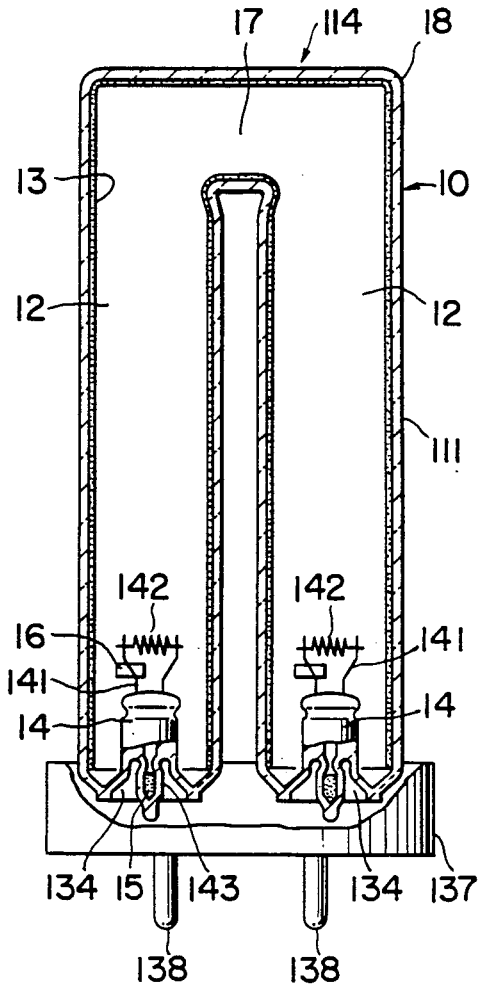
FIG. 3 is a diagrammatic sectional view of an alternative preferred embodiment of a low pressure mercury vapor discharge lamp according to the present invention.
Figure 4:
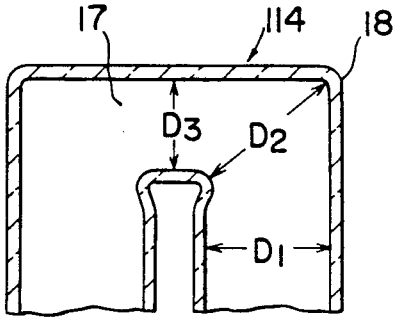
FIG. 4 is a diagrammatic sectional view showing a folded portion and dimension thereof of the low-pressure mercury vapor discharge lamp of FIG. 3.

FIGS. 3 and 4 show an alternative embodiment which is a U-shaped type fluorescent lamp according to the present invention. The lamp is characterized in a folded portion 114 of a discharge passage 12, while the other configuration is same as the H-shaped type fluorescent lamp shown in FIG. 1. Only the difference from the H-shaped type fluorescent lamp is only described in detail. A bent portion 17 of a tube 10 is formed by bending the intermediate portion of a long longitudinal tube 111 in a U-shape. Throughout the drawings, reference numerals are the same, and like letters are used to designate like or equivalent elements. As is shown in FIG. 4, the inside diameters of the longitudinal portion of the tube 10, the bent portion 18 and a height portion of the bent portion 17, $D_1$, $D_2$ and $D_3$, respectively, satisfy the following relation.

$$D_3 < D_1 < D_2$$

Further, for the main amalgam 15, the same amalgams I, II, III and IV as the first embodiment described above are employed.

Also in this embodiment, the cooling capability of a folded portion 114 is adequately low. When the lamp is turned on in the base up state, the folded portion 14 is positioned in the downward direction so that it is cooled by natural cooling to form a low temperature region in a bent corner portion 18. The mercury vapor pressure in the tube 10 is controlled by either the pure mercury in the low temperature region or the main amalgam 15 whose mercury vapor pressure is lower than the other. When the ambient temperature is a room temperature, mercury condenses in the low temperature region, whereas the ambient temperature is high, the mercury vapor pressure in the tube 10 tends to be controlled by the main amalgam 15. The mercury vapor pressure in the tube 10 is thus adequately maintained. Furthermore, when the lamp is turned on in the base down state, the lowest temperature region is formed in other than the folded portion 114 so that the temperature does not reach the mercury condensation temperature in the folded portion 114. Owing to the lowest temperature region being formed in other than the folded portion 114 and the main amalgam 15, the mercury vapor pressure in the tube 10 is adequately maintained by the low temperature region or the main amalgam 15. As the lowest temperature region is formed in other than the folded portion 114, the mercury pressure vapor is effectively controlled by the amalgams 5 and 6, not the folded portion 114.

As is understood by the foregoing, the U-shaped type fluorescent lamp can maintain the mercury vapor pressure in wide range of ambient temperatures, irrespective of it being in the base up state or base down state. Furthermore, the mercury vapor pressure in a tube 10 rarely fluctuates even if the ambient temperature does, so that the lamp has desirable starting characteristic and also a high luminous efficacy.

The configuration of each of the folded portions 14 and 114 is geometrically defined in the above two embodiments. The condition for the each of the folded portion 14 and 114 is that the low temperature region be formed in the portion adjacent to the each of the folded portion 14 and 114 in the case of the base up state and is not formed in the folded portion 14 in the case of the base down state. If the configuration of the folded portion 14 varies, then the size also varies according to the configuration.

The reason why the solid and liquid phase coexisting melting point of the main amalgam 5 as the mercury vapor pressure is in the range of 0.01 to 0.2 Torr is as follows. When the amalgam in which the mercury tightly condenses, for example $C_5$ in FIG. 5, is also employed in the base up state, the mercury vapor pressure in a tube is controlled by the main amalgam, and the lowest temperature region formed in the folded portion does not control the mercury vapor pressure. On the contrary, if the amalgam in which mercury loosely condenses is also employed in the base down state, the amalgam does not adequately control the mercury vapor pressure, so that the mercury vapor pressure in a tube rises too high.

Therefore, in the present invention, the following two conditions must be satisfied at the same time. (1) A low temperature region is formed in the portion adjacent to a folded portion only in the case of the base up state. (2) The amalgam in which mercury adequately condenses only in the case of the base down state is selected.

The discharge passage may be formed in any shape such as a M-shape or a double U-shape if a discharge passage has the configuration such that the two end portions thereof are arranged in the same direction and at least one folded portion is arranged in the opposite direction. Furthermore, this invention may be applied to an ultraviolet discharge lamp.

The low-pressure mercury vapor discharge lamp according to the present invention is provided such that amalgam is arranged in the end portion of a discharge passage whose two end portions are arranged in the same direction and which has at least one folded portion in the opposite direction and in which a low temperature region is formed in an inner face of a tube adjacent to the folded portion when the lamp is turned on in the state where the folded portion is oriented in a downward direction in the field of gravity, whereas the lowest temperature region is formed in another portion, e.g. the end portion when the lamp is turned on in the state where the folded portion is oriented in a downward direction in the field of gravity. Furthermore, the amalgam whose mercury vapor pressure is in the range of 0.01 to 0.2 Torr at a solid and liquid coexisting critical temperature is employed.

Therefore, the mercury vapor pressure in the tube is controlled by the mercury vapor pressure of either one of the low temperature regions formed in the portion adjacent to the folded portion or the amalgam which is lower than the other when the lamp is turned on in the base up state. On the contrary, when the lamp is turned on in the base down state, the mercury vapor pressure in the tube is controlled in such a way that a low temperature region formed in other than the folded portion or amalgam controls the density of mercury. Owing to that, the mercury vapor pressure is adequately maintained over a wide temperature range for both cases, and in addition, a preferable starting characteristic and luminous efficacy are obtained. Furthermore, mercury does not drop even if the lamp is turned on in the base down state. Claims 2 and 3 disclose the structure of the folded portion defined numerically so as to obtain the above mentioned effect in a H-shaped and U-shaped low pressure mercury vapor discharge lamps, respectively.

What is claimed is:

1. A low-pressure mercury vapor discharge lamp having a glass tube in which a successive discharge passage is formed as having two end portions arranged in the same direction and a folded portion in the direction opposite said end portions, a pair of electrodes provided at said end portions and amalgam provided in an end portion of said glass tube in the same direction as said portions and for controlling the mercury vapor pressure, wherein:

said tube has such a configuration that a low temperature region is formed in a portion of said tube around a folded portion when said lamp is turned on in the state where said folded portion is oriented in a downward direction, whereas, said low temperature region is formed elsewhere than said folded portion when said lamp is turned on in the state where said folded portion is oriented in an upward direction, at a normal temperature; and the mercury vapor pressure at a solid and liquid phase coexisting critical temperature of said amalgam is in the range of 0.01 to 0.2 Torr.

2. A low-pressure mercury vapor discharge lamp according to claim 1 wherein said discharge passage is formed in a double U-shape.

3. A low-pressure mercury vapor discharge lamp according to claim 1 wherein said discharge passage is formed in a double M-shape.

4. A low-pressure mercury vapor discharge lamp having a glass tube in which a successive discharge passage is formed as having two end portions arranged in the same direction and a folded portion in the direction opposite said portions, a pair of electrodes provided between said portions and amalgam provided in an end portion of said glass tube in the same direction as said portions and for controlling the mercury vapor pressure, wherein:

said tube is formed such that said two end portions and said folded portion are joined to each other through two straight tubes and a connecting tube section;

the distance l between a center line of said connecting tube section and an inner wall of an end portion of the straight tube portion separated from said discharge passage satisfy the relationship $l \leqq 0.8\ D_1$ with an inside diameter $D_1$ of said straight tube portion; and mercury vapor pressure at a solid and liquid phase coexisting critical temperature of said amalgam is in the range of 0.01 to 0.2 Torr.

5. A low-pressure mercury vapor discharge lamp having a glass tube in which a successive discharge passage is formed as having two end portions arranged in the same direction and a folded portion in the direction opposite said portions, a pair of electrodes provided between said portions and amalgam provided in an end portion of said glass tube in the same direction as said portions and for controlling the mercury vapor pressure, wherein:

said tube is formed such that said folded portion arranged in the opposite direction to said two end portions is bent in a U-shape;

inside diameters of a straight portion of said tube, a portion on the way of said folded portion and a summit portion of said folded portion in $D_1$, $D_2$ and $D_3$, respectively satisfy the relationship $D_3 < D_1 < D_2$ with each other; and the mercury vapor pressure at a solid and liquid phase coexisting critical temperature of said amalgam is in the range of 0.01 to 0.2 Torr.

* * * * *